US005380965A

United States Patent [19]

Møller

[11] Patent Number: 5,380,965

[45] Date of Patent: Jan. 10, 1995

[54] ELECTROMECHANICAL PULSE GENERATOR

[75] Inventor: Niels T. Møller, Roskilde, Denmark

[73] Assignee: Microtronic A/S, Roskilde, Denmark

[21] Appl. No.: 87,780

[22] PCT Filed: Dec. 17, 1991

[86] PCT No.: PCT/DK91/00395

§ 371 Date: Jul. 7, 1993

§ 102(e) Date: Jul. 7, 1993

[87] PCT Pub. No.: WO92/12522

PCT Pub. Date: Jul. 23, 1992

[30] Foreign Application Priority Data

Jan. 11, 1991 [DK] Denmark ..... 0052/91

[51] Int. Cl.[6] ..... H01H 21/80

[52] U.S. Cl. ..... 200/11 R; 200/24

[58] Field of Search ..... 200/1 R, 1 B, 4, 6 R, 200/6 B, 6 BB, 6 C, 7, 11 R, 11 A, 11 K, 11 E, 11 EA, 11 S, 11 G, 11 H, 11 TC, 17 R, 17 B, 18, 19 R, 20–22, 23, 24, 27 R, 28, 30 R, 61.39, 290, 291, 336, 501, 564, 565, 568, 572; 307/106, 132 R, 132 M; 368/90–100, 148, 210–219

[56] References Cited

U.S. PATENT DOCUMENTS

| | | | |
|---|---|---|---|
| 4,395,604 | 7/1983 | Tominaga | 200/74 |
| 4,894,494 | 1/1990 | Rösl et al. | 200/11 R |
| 5,194,704 | 3/1993 | Michalski et al. | 200/11 R |

OTHER PUBLICATIONS

International Patent Publication No. WO 89/12904, dated Dec. 28, 1989, to D. Michalski et al.

*Primary Examiner*—A. D. Pellinen
*Assistant Examiner*—Michael A. Friedhofer
*Attorney, Agent, or Firm*—Watson, Cole, Grindle & Watson

[57] ABSTRACT

An electromechanical pulse gereator having a purely mechanical mode of operation for microelectronic equipment, e.g. volume control in hearing aids, consisting of a housing formed by a fixed base portion in which a shaft is fixedly mounted and a timing wheel is rotatably mounted around the shaft, the timing wheel having the form of a downward facing open cylinder and being fixedly connected to a casing whci forms an external handle. The inner cylinder surface of the timing wheel is provided with grooves engaging with a protrusion of a circular carrier rotatably mounted around the shaft. A U-shaped contact spring has members which are individually imparted an oscillating movement between contact pairs A-B-C and A-D-E, respectively, by the turn of the timing wheel in one or the other direction via the carrier which can only move over a pre-determined circular section, so as to generate digital pulse trains. A locking device prevents the carrier from moving beyond the pre-determined circular section and causes the protrusion to continuously engage with the grooves by the turn of the timing wheel.

3 Claims, 4 Drawing Sheets

ELECTROMECHANICAL PULSE GENERATOR

BACKGROUND OF THE INVENTION

1. Field of the Invention

The present invention relates to an electromechanical pulse generator for digital voltage control in an electronic apparatus, preferably a microelectronic apparatus, such as volume control in a hearing aid.

2. The Prior Art

Microelectronic devices without digital voltage control for volume control in hearing aids are disclosed in e.g. DK-C-134,876 and DK-A-1229/89 which relate to volume control devices in hearing aids by use of a potentiometer path or a self-aligning miniature converter, respectively. However, the use of digital electronics is particularly desirable in microelectronic hearing aids as it allows better results to be obtained than the hitherto non-digitally controlled devices. Thus, there is a need for a voltage control device which is immediately applicable within the digital electronics field and which allows a very accurate adjustment of the parameters of a hearing aid, thus furthermore making the apparatus user friendly.

Electromechanical pulse generators far digital voltage control are known from e.g. radio and television sets, in which, however, such pulse generators are provided with components of an optical, magnetic or similar character. Thus, a digital voltage control based on the light/shadow effect in an optical component incorporated in the equipment is known from e.g. the electronic equipment of radios. Due to the size of such constituent parts these electromechanical pulse generators are obviously not suitable as parts of a microelectronic hearing aid in which the total outer dimensions of the components are to be in the magnitude of 3–4 mm. In Applicant's earlier patent application DK-A-1838/90 it has been attempted to minimize equipment of this type for microelectronic use by use of an electromechanical pulse generator. However it has turned out to be relatively difficult and complicated to manufacture and mount the pulse generator due to its relatively large number of vulnerable single components of very small size as well as the relatively large possibilities of functional errors arising during use of the pulse generator due to the complex cooperation between the single components.

U.S. Pat. No. 4,282,415 discloses another pulse generator of the said type which is also suitable for minimization. This pulse generator is i.a. characterized by having two simple switch sets which are placed symmetrically and which work in the same manner for closing an electric circuit using an impact effect, as a resilient contact member of the individual switch set is brought to abut against a fixed contact member of the switch set. However, in this construction the contact impact may have an unfavourable effect in connection with the electric circuit as the impact may produce undesired multiple activations of the circuit merely by turning of the rotor of the pulse generator a single step.

Finally, WO 89/12904 discloses a mechanical pulse generator likewise suitable for minimization. This pulse generator has a rotatable crown with internal toothing in which a cam on an oscillating sleeve abutting on a spring element engages. Each of the two ends of the spring element moves, in function of the chosen direction of rotation, between two contacts of one of two pairs of contacts while a contact pin mechanically pretensions the spring element and hence the oscillating sleeve accordingly. The mode of function of this pulse generator is entirely depending on the double function of the spring element acting both as a pretension of the oscillating sleeve and as a contact spring between the contact pin and each pair of contacts, respectively. This mode of function involves a mounting of the spring element and the two pins of contacts partly outside the circumference of the rotatable crown which, however, is detrimental to a minimization of the construction down to dimensions acceptable to the use of the generator as part of a microelectronic hearing aid. Further, the double function of the spring element demands a spring characteristic which may be difficult to obtain when minimizing the spring element further down to the desired use in a hearing aid.

SUMMARY OF THE INVENTION

Therefore, it is the object of the present invention to provide an electromechnical pulse generator with a purely mechnical mode of operation for digital voltage control in microelectronic equipment which remedies the above mentioned disadvantages of the prior art pulse generators and which is suitable for being manufactured with very small outer dimensions for an effective and flawless functioning during the life of the product while at the same time having a few, simple and mutually cooperating components, which thus also allows the pulse generator to constitute a surprisingly inexpensive product.

The object is obtained by means of an electromechanical pulse generator of the type stated in the introductory part of claim 1, the characteristic features of which are stated in the characterizing part of the claim.

The pulse generator according to the invention may furthermore contain the features stated in claims 2 and 3.

Thus, the pulse generator according to the present invention can, like the pulse generators according to Applicant's earlier application DK-A-1838/90 and to the international application WO 89/12904, be minimized to the outer dimensions required for the microelectronic use in question and is a purely mechanical component having a tuning knob which can be turned endlessly in either direction and which is not provided with any form of end stop. This means that the adjustment of the hearing aid becomes independent of the absolute position of the tuning knob, as the adjustment is expressed exclusively through the relative turn of the tuning knob in relation to a basic position, and that the shift from one terminal to another terminal of a pair of terminals in the electronic circuit, e.g. in a hearing aid, results in the elimination of the above mentioned negative effects of contact impact.

The invention will be explained in further detail below with reference to the accompanying drawings in which FIGS. 1–5 diagrammatically illustrates an example of a non-limiting embodiment of the invention.

DETAILED DESCRIPTION OF THE PREFERRED EMBODIMENTS

Figure 1:
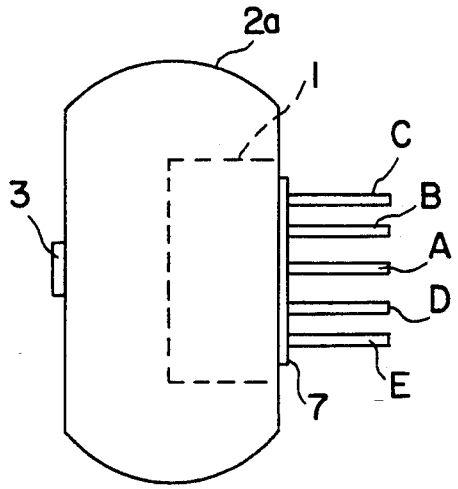
FIG. 1 is a side view of an electromechanical pulse generator provided with a wheel-shaped handle or a wheel-shaped tuning knob.
Figure 2:
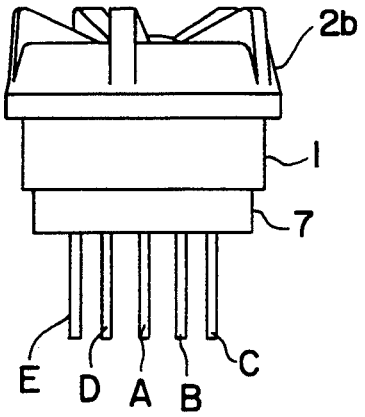
FIG. 2 is a pulse generator with a tuning knob having catch fans.

In FIGS. 1 and 2, which are both side views of a pulse generator which have been enlarged about 10 times, 1 designates a timing wheel which is fixedly mounted in an outer casing 2*a*, 2*b* and which is mounted rotatably around a shaft 3 (FIG. 1) which is attached in a base portion 7 on the pulse generator. Furthermore, in the base portion 7 contact members in the form of a single contact member A and two pairs of terminals B–C and D–E are attached to two converters mounted in the housing, the function of which converters will be discussed below. The surrounding casing, which can be freely rotated around the shaft in both directions, may have the form of an externally knurled wheel 2*a* (FIG. 1) or it may be provided with catch fans 2*b* (FIG. 2).

Figure 3:
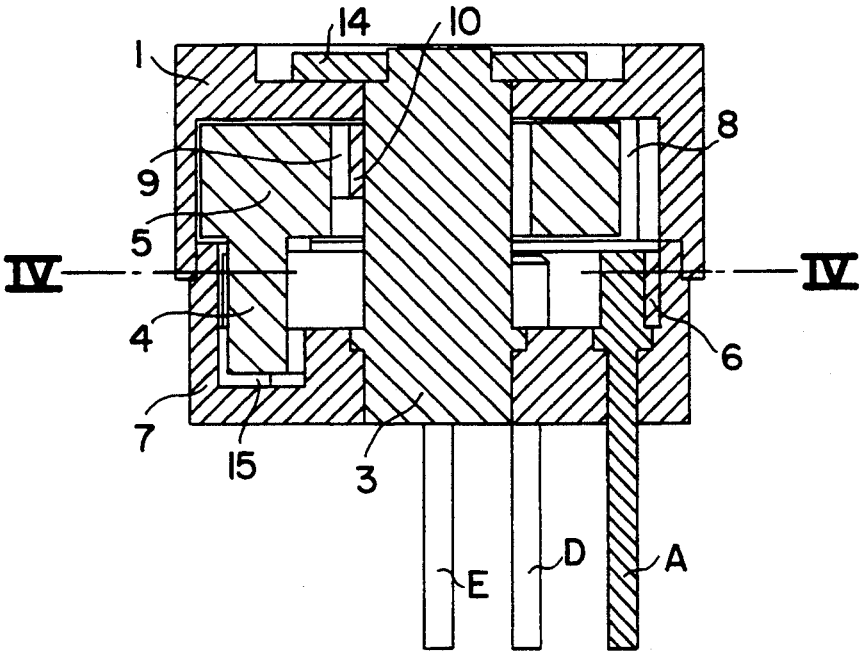
FIG. 3 is a vertical sectional view through a pulse generator along the line III—III of FIG. 4.
Figure 4:
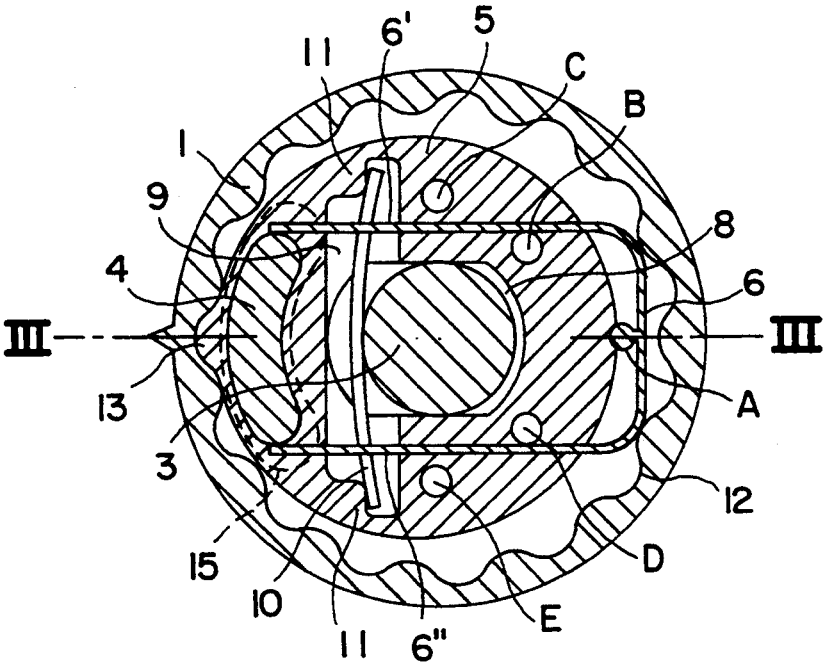
FIG. 4 is a horizontal sectional view through a pulse generator along the line IV—IV of FIG. 3.
Figure 5A:
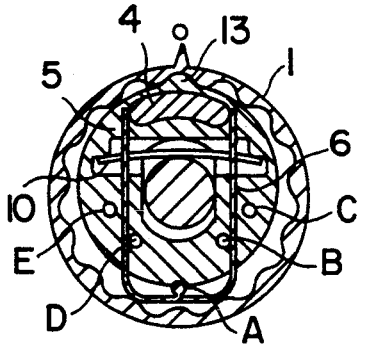
FIG. 5(*a*)–5(*d*) illustrates different steps of the mechanical functioning of the pulse generator.
Figure 5B:
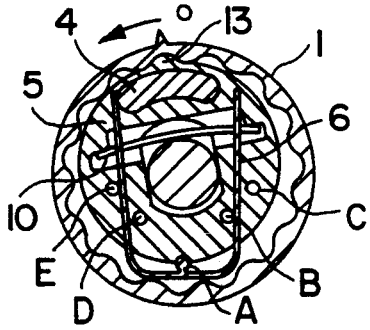
Figure 5C:
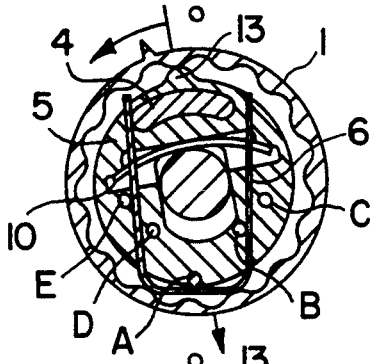
Figure 5D:
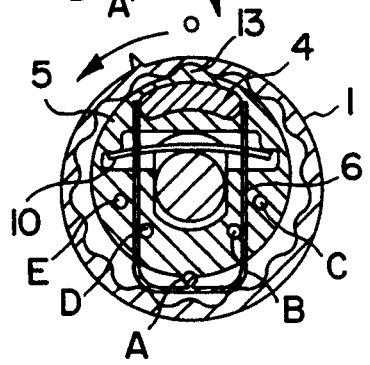

FIGS. 3 and 4 are both illustrations of the invention which have been enlarged about 20 times showing a vertical and a horizontal sectional view, respectively, through the pulse generator without the casing 2*a*, 2*b*. By means of a retention plate 14 the timing wheel 1 is mounted rotatably around the shaft 3 which is mounted in the base portion 7 in which the contact members are also mounted (in FIG. 3 only shown as A and the pair D–E). The upper portion of the contact members projects a distance above the upward facing inner surface of the base portion. A U-shaped flat spring 6 having legs 6′ and 6″ forms a common contact spring for the terminals and is rigidly attached to the single contact member A at the "lower" portion of the U and is moreover placed parallel with the horizontal surfaces of the base portion inside a free space in the housing formed by the lower surface of the timing wheel 3 and the upper surface of the base portion 7 so that the contact spring in its non-actuated position abuts on terminals B and D of the pair of terminals B–C and D–E, respectively, whereas it can be brought to abut against the terminals C and E of the same two pairs of terminals, respectively, by an outer effect, see below.

A circular carrier 5 is also mounted rotatably around the shaft 3 inside the housing and above the spring, said carrier being provided along its outer periphery with a protrusion 13 and on its downward facing surface with another sectional circular protrusion 4 which can be moved in a circular groove 15 in the base portion 7. The central cutout 8 of the carrier and the complementary shape of the protrusion 4 and the groove 15 furthermore allow a diametrical movement of the carrier inside the housing during a certain effect which will be discussed below.

The timing wheel 1, which in principle has the form of a downward facing open cylinder, is on its inner vertical cylinder surface in a known way provided with corrugated grooves 12 disposed parallel with the axis which are independently intended to hold the protrusion 13 of the carrier 5.

In a cutout 9 in the carrier perpendicular to the diametrical plane in which the carrier moves, another flat spring 10, the locking spring, is placed which when pre-tensioned abuts on both the shaft 3 and the shoulders 11 in the cutout 9 (FIG. 4), and which through its spring load effect maintains the protrusion 13 in a groove 12.

From a position with the horizontal protrusion 13 maintained in a groove 12, the downward facing protrusion 4 of the carrier 5 shown in FIG. 3 can be moved to one or the other side in the groove 15 in the base portion 7 by turning of the timing wheel 1. As indicated with dotted lines in FIG. 4, the groove 4 covers about 1/5 of a circle. If the timing wheel is turned to one of the sides from the position in which the contact spring 6 is in a rest position and in which contact legs 6′ and 6″ abut against contact member terminals B and D, thereby bringing e.g. contact leg 6″ to abut against terminal E, the further movement of the protrusion 4 in the direction of turning is stopped by the end stop of the groove 15 and so is also the further turning of the carrier. If turning of the timing wheel 1 proceeds, the protrusion 13 slides over the peak between the two grooves 12, as the cutout 8 and the groove 15 permit the carrier 5 to perform a corresponding diametrical movement backwards against the force of the locking spring 10. As soon as the protrusion 13 has passed the peak between two grooves, the spring 10 again pushes the carrier 5 forwards into engagement with the protrusion 13 in the subsequent groove 12. By means of the spring load effect from the leg 6″ against the adjacent end of the protrusion 4 in direction towards the starting position, the contact spring 6 simultaneously returns the protrusion 4 to the center position in the groove 15. Thus, a continued turning of the timing wheel 1 in the subsequent direction will result in a corresponding number of engagements of the protrusion 13 in the grooves 12 and a corresponding number of movements of the contact spring legs 6′ and 6″ between the neutral positions A8 and AD, respectively, and the corresponding activated positions AC and AE, which in practice are marked by a number of "notches" or clicks caused by the movements of the protrusion 13 into and out of the grooves 12.

Figure 6:
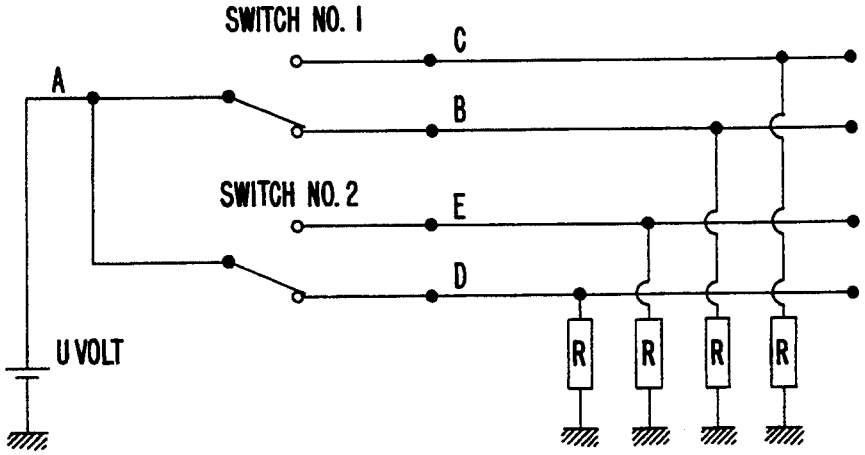
FIG. 6 is a circuit diagram illustrating the principles of the converter functions according to the invention.
Figure 7:
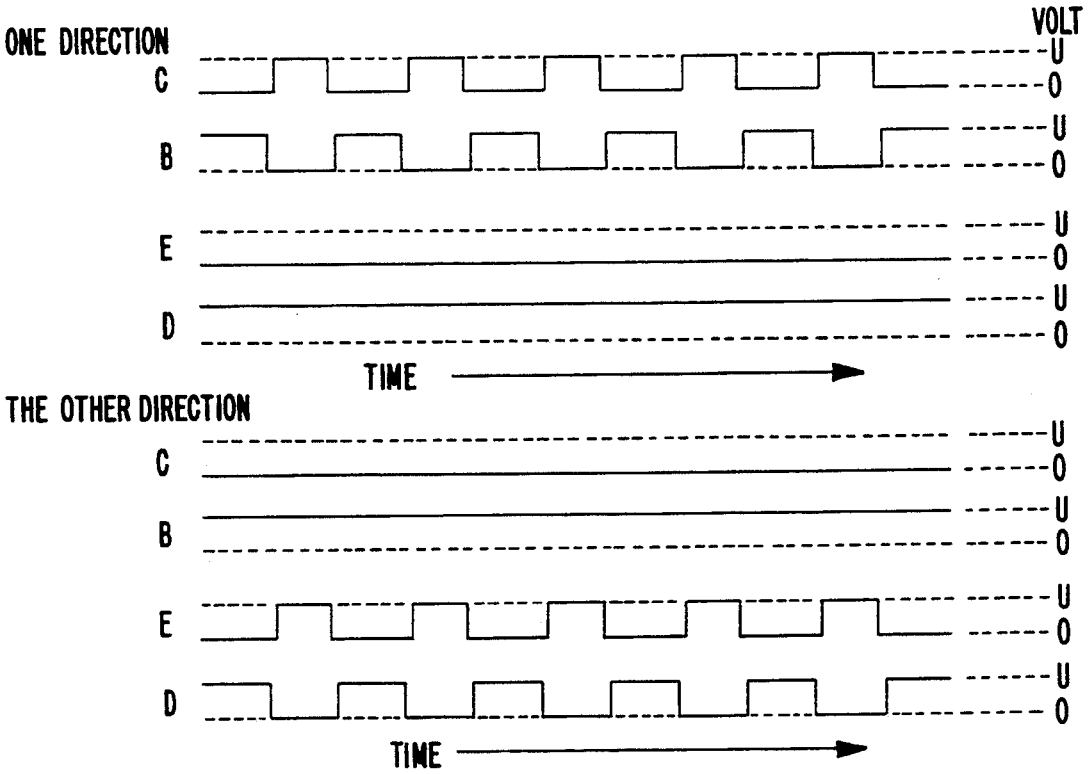
FIG. 7 is a circuit diagram of e.g. the digital pulse trains generated in the circuits according to the invention.

This mode of operation of the pulse generator and the results thereof are shown in FIGS. 5, 6 and 7. In FIG. 5 positions (a), (b), (c) and (d) indicate the movements of the parts of the pulse generator by turning of the timing wheel 1 in direction of the arrow. In (a) the pulse generator is in its neutral position with the legs of the contact spring 6 abutting against terminals B and D and the protrusion 4 in a center position in the groove (not shown) in the base portion.

In (b) the carrier 5 together with the timing wheel 1 are turned to the left, thereby causing the protrusion 4 to push the left leg of the contact spring 6 to abut against terminal E. Switch No. 2 shown in FIG. 6 consequently shifts from the neutral position (A–D) to the activated position (A–E).

In (c) the turning of the timing wheel 1 proceeds, but due to the stop in the form of the left end of the groove 15 in the base portion for the protrusion 4, the carrier 5 does not move, and the protrusion on the periphery of the carrier slides over the peak between two grooves in the timing wheel, thereby causing the carrier to be pushed diametrically backwards against the force of the spring 10.

In (d) the carrier returns to its starting position, as the protrusion on the periphery of the carrier is pushed into the subsequent groove on the inner surface of the timing wheel 1 due to the spring load effect of the spring 10 and at the same time the spring power in the left leg of the contact spring 6 against the left end of the protrusion 4 pushes the latter back into the center position so as to re-abut against terminal D.

Thus, each time the protrusion 13 passes from one groove to another, switch No. 2 represented by terminals A, D and E (FIG. 6) will perform a switch function and produce a pulse train corresponding to the number of peaks between the grooves which the protrusion 13 passes. This pulse train is used e.g. for digital voltage control in the form of a reduction in the signal volume in a hearing aid. Switch No. 1 represented by terminals A, B and C in FIG. 6 will be similarly activated by turning of the timing wheel in the opposite direction and cause a digital voltage control for an increase in volume.

The courses of the pulse trains are shown in FIG. 7 which at the top depicts the pulse trains by activation of switch No. 1 with terminals B and C and which at the bottom depicts the pulse trains for switch No. 2 with terminals D and E. As mentioned above, each switch has the form of a resilient leg of the contact spring 6 rigidly attached to terminal A and oscillating between the two terminals of each pair of terminals B–C and D–E. As will also appear from FIG. 7, the non-activated spring leg will be in a neutral position during the rotational movement of the timing wheel.

I claim:

1. An electromechanical pulse generator for digital voltage control in an electronic apparatus, preferably a microelectronic apparatus, such as a volume control in a hearing aid, consisting of a non-electrically conductive housing having a fixed base portion (7) in which an outwardly projecting, single electrically conductive contact member (A) and likewise outwardly projecting electrically conductive pairs of terminals (B–C and D–E) are mounted, a vertical shaft (3) mounted in the base portion (7) and a timing wheel (1) mounted rotatably around the shaft, said timing wheel being fixedly mounted in an outer casing (2), and where the vertical inner surface of the timing wheel (1) is provided with grooves (12) disposed parallel with the axis, and where a circular carrier 5 is also rotatably mounted around the shaft (3) inside the housing and being at its outer periphery provided with a protrusion (13) which engages with the grooves (12) on the inside of the timing wheel (1), and where the circular carrier (5) is furthermore mounted around the shaft (3) in a manner so as to leave an inner space between the lower surface of the carrier (5) and the upper surface of the base portion (7) and to cause the carrier to perform a diametrical movement inside the housing when the protrusion (13) passes the peak between two adjacent grooves (12) during a rotational movement of the timing wheel (1), characterized in that a locking spring (10) is mounted in a cavity (9) inside the carrier (5) and pretensioned abutting against vertical inner surfaces of the cavity (9) and the vertical surface of the shaft (3) for controlling the diametrical movement of the carrier (5) inside the housing, that the carrier (5) symmetrically in relation to the protrusion (13) and immediately behind same and on the lower surface of the carrier comprises a downwardly facing protrusion (4) parallel with shaft (3), that the base portion (7) is provided with a sectional circular groove (15) of a form similar to that of the protrusion (4) and of a size allowing for a limited movement of the protrusion (4) diametrically as well as circularly, that the outwardly projecting contact member (A) as well as the outwardly projecting pairs of terminals (B–C and D–E) are all mounted in the base portion (7) within the smaller inner circumference of the timing wheel (1) and that a U-shaped contact spring (6) with spring legs is mounted in the space between the carrier (5) and the base portion (7) and with the closed end of the U rigidly attached to the single contact member (A) and in the neutral position of the pulse generator with said spring legs (6',6'') abutting partly against the adjacent vertical end surface of the protrusion (4) facing downwardly from the carrier (5) and partly against each of the inner terminals of the pairs of terminals (B–C and D–E), respectively.

2. An electromechanical pulse generator according to claim 1, characterized in that the groove (15) in the base portion (7) and serving as a stop device for the protrusion (4) of the carrier has a length which allows the protrusion to move only inside a circular section corresponding to about 1/5 of the circumference of the carrier.

3. An electromechanical pulse generator according to claim 1, characterized in that the pairs of terminals (B–C and D–E) each together with the single contact member (A) forms two switches, each terminal of each pair of terminals being individually connectable with the contact member (A) by one and the same contact spring (6).

* * * * *